US005271290A

United States Patent [19]

Fischer

[11] Patent Number: 5,271,290

[45] Date of Patent: Dec. 21, 1993

[54] ACTUATOR ASSEMBLY

[75] Inventor: Patrick J. Fischer, Oxford, United Kingdom

[73] Assignee: United Kingdom Atomic Energy Authority, Oxfordshire, England

[21] Appl. No.: 46,905

[22] Filed: Apr. 14, 1993

Related U.S. Application Data

[63] Continuation of Ser. No. 960,826, Oct. 14, 1992, abandoned.

[30] Foreign Application Priority Data

Oct. 29, 1991 [GB] United Kingdom ..... 9122903

[51] Int. Cl.[5] ..... G05G 9/047

[52] U.S. Cl. ..... 74/471 XY; 74/479 R; 74/479 BP; 74/479 PF; 74/479 PM; 901/15; 901/23

[58] Field of Search ..... 74/471 XY, 479 R, 479 BP, 74/479 PF, 479 PM; 248/661; 901/15, 23; 244/234, 236

[56] References Cited

U.S. PATENT DOCUMENTS

| | | | |
|---|---|---|---|
| 3,215,391 | 11/1965 | Storm | 74/471 XY X |
| 4,169,443 | 10/1979 | Todeschini | 123/367 |
| 4,216,467 | 8/1980 | Colston | 341/20 |
| 4,806,068 | 2/1989 | Kohli et al. | 901/23 X |
| 5,125,602 | 6/1992 | Vauvelle | 244/223 |
| 5,151,008 | 9/1992 | Ishida et al. | 74/479 X |

FOREIGN PATENT DOCUMENTS

| | | |
|---|---|---|
| 0363739 | 4/1990 | European Pat. Off. . |
| 0384806 | 8/1990 | European Pat. Off. . |
| 2228783 | 9/1990 | United Kingdom . |

OTHER PUBLICATIONS

H. Inoue, Y. Tsusaka, and T. Fukuizumi, "Parallel Manipulator," Robotics Research, The 3rd International Symposium, The MIT Press, Cambridge pp. 321-327, 1986.

F. Pierrot, A. Fournier, and P. Dauchez, "Towards A Fully-Parallel 6 DOF Robot For High-Speed Applications," Proceedings of the 1991 IEEE, International Conference on Robotics and Automation, Sacramento, California, Apr. 1991.

*Primary Examiner*—Leslie A. Braun
*Assistant Examiner*—William O. Trousdell
*Attorney, Agent, or Firm*—William R. Hinds

[57] ABSTRACT

An actuator assembly (14) suitable for use in a hand controller (10) with six degrees of freedom of movement consists of a pair of arms (20) each secured at one end to a respective rotary actuator (26), and at the other end secured to a common universal joint (21). The arms (20) are coupled directly to the drive shafts (25) of the rotary actuators (26) and their movement is restricted.

6 Claims, 3 Drawing Sheets

13
C
III
10
18
D
12
21
14
23
20
27
17
28
29
24
A
26
25
16
15

ACTUATOR ASSEMBLY

This is a continuation of application Ser. No. 07/960.826 filed Oct. 14, 1992 now abandoned.

This invention relates to an actuator assembly and more specifically to an actuator assembly for use with a parallel platform structure such as a hand controller.

BACKGROUND OF THE INVENTION

Parallel platform structures have found use in such applications as flight simulators, manipulators and hand controllers. These structures may typically be envisaged as having two triangular platforms: a top platform which is free to move in relation to a base platform which is fixed. These platforms are typically connected to each other at their corners via six linear actuators to form an octahedral structure. By altering the length of the linear actuators it is possible to locate the top platform in a variety of positions or orientations with respect to the base platform. Parallel platform structures of this type have a top platform which has six degrees of freedom of movement. However it is difficult to design parallel platform structures which have large working volumes using linear actuators, and it is also difficult to incorporate adequate back-drivability into these actuators. These problems are particularily acute when designing compact parallel platform structures. Pantograph actuators which are operated by planetary geared motors have been proposed by H. Inoue et al as an alternative to linear actuators for use in parallel manipulators.

These pantograph actuators are of limited suitability for use in hand controllers due to their high torque noise which is a consequence of the use of a planetary gear mechanism. Also the varying inertia associated with different motor positions around the sun gear would be difficult to compensate for in a hand controller and would reduce its sensitivity. Also as the whole motor assembly is involved in the motion of any leg pair the effective inertia of the system is increased and sensitivity is again reduced. The inertia problems associated with planetary geared pantographic actuators make it difficult to provide the desired level of force feedback to devices incorporating these actuators. It is desirable that hand controllers are convenient to use and have adequate force feedback and back-drivability so as to minimize operator fatigue.

SUMMARY OF THE INVENTION

According to the present invention there is provided an actuator assembly which comprises a pair of arms, each arm comprising upper and lower arm sections pivotally connected to each other, with said upper arm sections being joined at a three axis universal joint, and with said lower arm sections being attached independently of each other to a respective one of two rotary actuators, both rotary actuators being secured to a base via a common pivoting member.

According to a further aspect of the invention there is provided a hand controller which comprises three such actuator assemblies secured to a top plate via their three axis universal joints, the bases of the three actuator assemblies being spaced apart from each other.

The actuator assembly may be used in any application which requires a parallel platform structure with up to six degrees of freedom of movement. Such applications include flight simulators, parallel manipulators, robotics and hand controllers. Hand controllers may be used to control the movements of remote mechanisms such as manipulator slave arms, robots, remote vehicles and in such applications as the control of fly-by-wire aircraft.

The rotary actuators are preferably electrical direct drive motors. By direct drive it is meant that no gearing is involved in the operation of the motor so that the motor induces a direct response in the arm attached to its drive shaft. Most preferably the electrical direct drive motors are limited angle torque motors (LAT) such as brushless DC torque motors. These motors advantageously exhibit low magnetic and mechanical friction torque and very low reluctance and ripple torque, which results in a high quality force signal being generated from the actuator assembly. The use of direct drive limited angle torque motors produces an actuator assembly which is relatively compact but with a large working volume and improved force feedback.

It is preferred that the axis about which the pivoting member of an actuator assembly is able to pivot is perpendicular to but in the same or a parallel plane to the axis of rotation of the rotary actuators, this pivoting axis being stationary. It is preferred that the rotary actuators of an actuator assembly rotate about the same axis.

As the rotary actuators are located within a pivoting member attached to a base the actuator assembly mechanism is statically balanced in all positions in respect of the motor assemblies and at no time does motion of the actuator assembly involve displacements of the centre of mass of any pivoting member and the motors on it.

Preferably means are incorporated into the actuator assembly to enable it to communicate with and/or be controlled by the outside world. Such means include sensors and encoders which provide electrical signals which can be interpreted by for example a computer to identify the orientation of the actuator assembly and to control it.

Preferably means are incorporated in the hand controller to provide force feedback in relation to each degree of freedom of the handle. The fed-back forces and torques may be directly proportional to the forces exerted by corresponding joints of the mechanism being controlled, though to minimize operator fatique some forces exerted by the mechanism, such as those due to the weight of an object being manipulated, or due to frictional effects in the joints, may be partially or completely filtered out.

Sensors in the hand controller provide electrical signals representing the forces or torques and the linear or angular displacements applied by the operator in each linear or rotary degree of freedom. These signals are desirably supplied to a computer, which provides corresponding control signals to motors in the mechanism being controlled. Different control modes may be selected during performance of a task by an operator, for example: position control, rate control, or force control (displacement of the handle causing, respectively, a corresponding displacement of, rate of movement of, or force exerted by, the mechanism); and for each such mode of control the constants of proportionality might also be varied. For example for large-scale motions of the mechanism rate control might be used, to move the mechanism to where a task is to be performed, and then for fine-scale movements of the mechanism during performance of the task, position control with a 1:1 ratio might be preferred.

It is preferred that the encoders or sensors for the rotary actuators are coupled directly onto the drive shaft of the actuator rather than via an intermediate coupling. This ensures the highest stiffness coupling between the encoder and the drive shaft which allows for higher bandwidth control of the motor and for the construction of a more compact unit. Suitable encoders for direct coupling are the Heidenhain ERO series of encoders.

BRIEF DESCRIPTION OF THE DRAWINGS

The invention will now be further described by way of example only, and with reference to the accompanying drawings, in which.

DESCRIPTION OF THE PREFERRED EMBODIMENT

Figure 1:
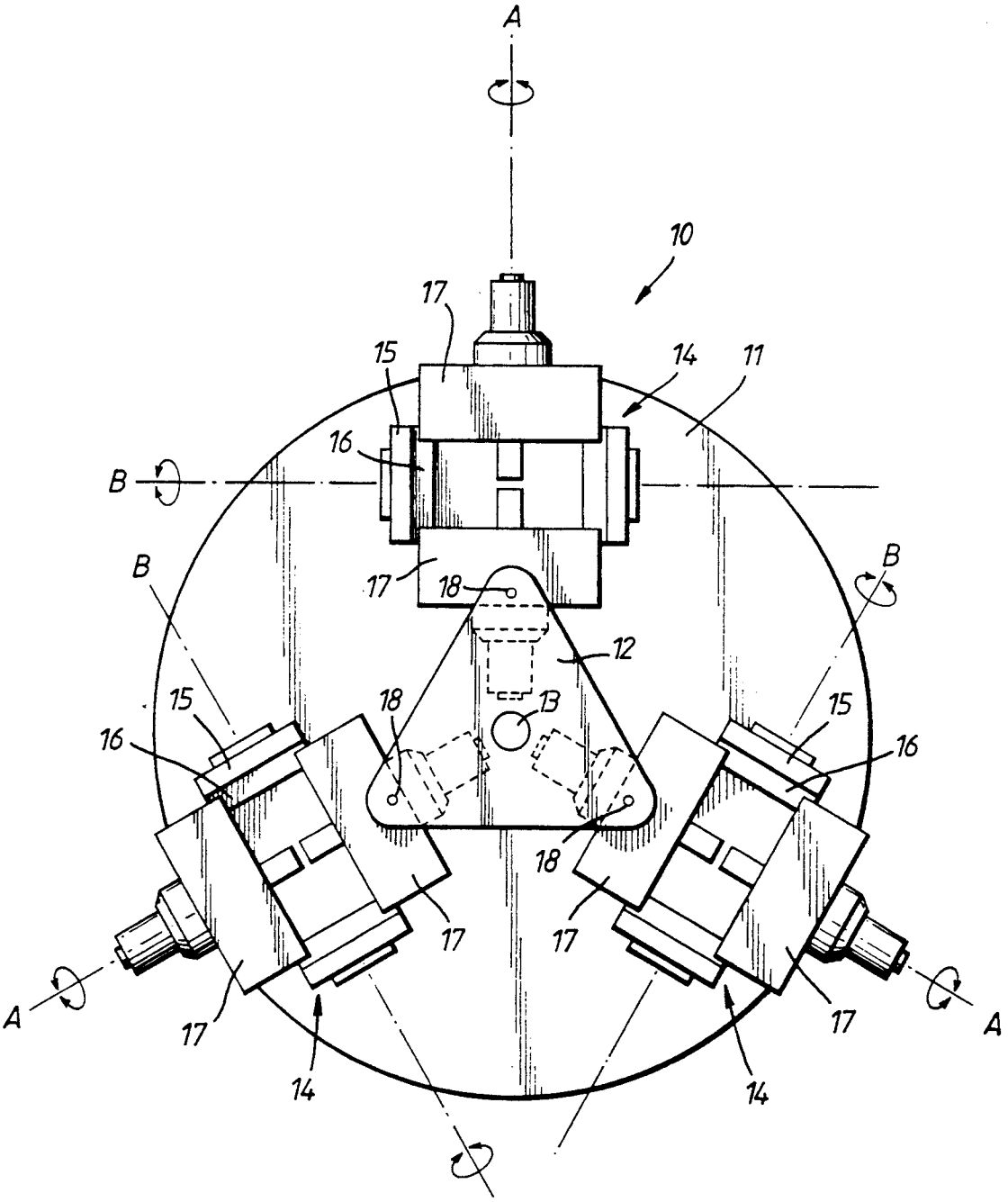
FIG. 1 shows a plan view of a hand controller including three actuator assemblies, but with all of the arms omitted for clarity.

Referring to FIG. 1 there is shown a hand controller 10 which comprises a supporting platform 11 which is connected to a top plate 12, via three actuator assemblies 14. The top plate 12 carries a handle 13. Each actuator assembly 14 comprises a base 15 for supporting a pivoting yoke 16 which retains a pair of rotary actuators (not shown in FIG. 1) which operate about an axis A and are located within respective actuator housings 17, a pair of pantograph arms (not shown in FIG. 1) and a universal joint (not shown in FIG. 1). Each actuator assembly 14 is secured to the supporting platform 11 via its base 15 such that each actuator assembly 14 is located at the vertex of an imaginary equilateral triangle and such that the axes A of the actuator assemblies 14 as seen in plan view intersect at the centre of the supporting platform 11. Each pivoting yoke 16 is able to pivot about an axis B, of each actuator assembly 14, in relation to the base 15 and supporting platform 11. The universal joints are secured to the top plate 12 at points 18.

Figure 2:
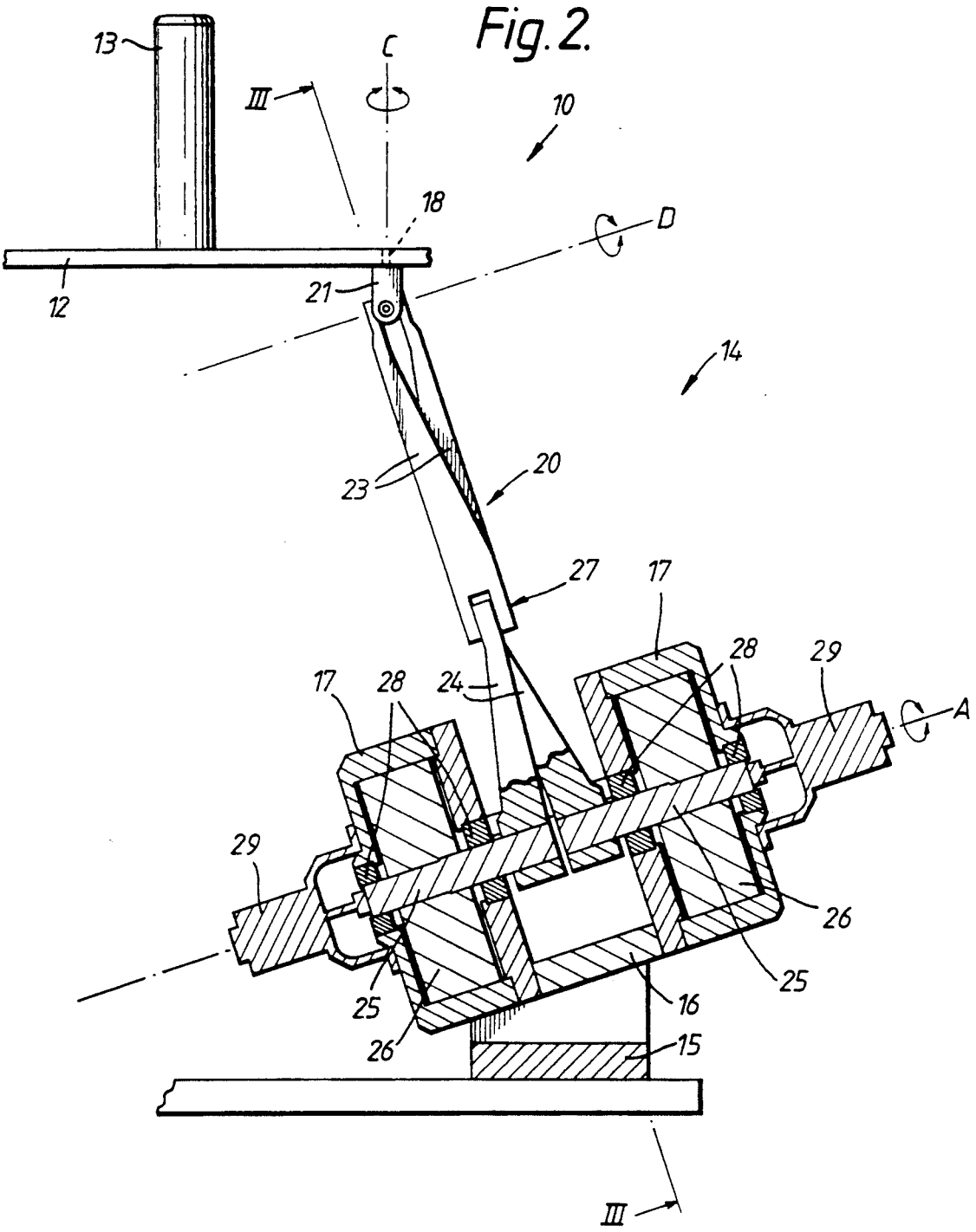
FIG. 2 shows a view, part in elevation and part in section of part of the hand controller of FIG. 1 showing an actuator assembly including its arms.
Figure 3:
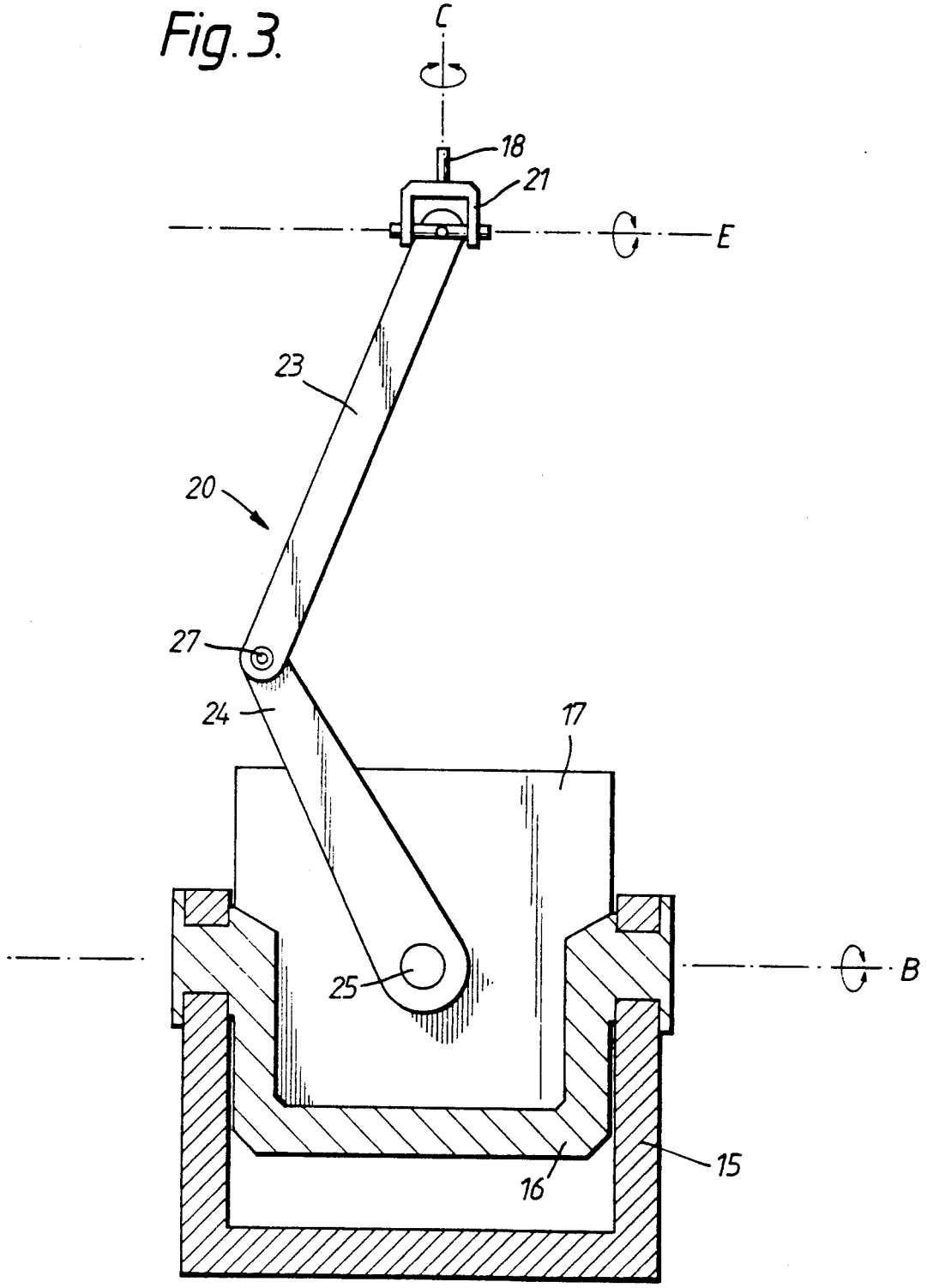
FIG. 3 shows a view, part in elevation and part in section, of an actuator assembly as viewed along the line III—III of FIG. 2.

Referring to FIG. 2 and 3 there is shown an actuator assembly 14 of the hand controller 10 shown in FIG. 1. A pair of pantograph arms 20 are attached to the top plate 12 by means of a universal joint 21. The universal joint possesses three rotational axes: C, D and E. The pantograph arms 20 possess upper and lower arm sections 23 and 24; the upper arm sections 23 are attached to and able to pivot about the axis D of the universal joint 21, while the lower arm sections 24 are fixed to respective driveshafts 25 of the pair of rotary actuators 26 such that they turn about axis A as the driveshafts 25 rotate. The upper and lower arm sections 23 and 24 of each pantograph arm 20 are pivotally connected to each other at point 27. The rotary actuators 26 are retained within the two actuator housings 17 which are attached to the pivoting yoke 16 secured to the base 15. The driveshafts 25 are supported by means of bearings 28 and are attached to encoders 29.

It will be apparent that the top plate 12 has six degrees of freedom of movement although its movement is somewhat restricted by the three actuator assemblies 14. The working volume of the hand controller 10 is related to the the angle of rotation about axis B of the pivoting yoke 16, the angles of rotation about axis A of the actuator driveshafts 25 and the relative angles between the upper and lower arm sections 23 and 24 of each pair of pantograph arms 20.

In operation of the hand controller 10 an operator can move the handle 13 (and with it the top plate 12) with six degrees of freedom: linear displacements in three orthogonal directions, and rotations about three orthogonal axes. Any such movements cause changes in the orientations of at least one of the lower arm sections 24 relative to the respective yoke 16 and hence rotation of the corresponding driveshaft 25. Consequently the signals from the encoders 29 enable a computer (not shown) to determine at all times the position of the handle 13 and the movement to which it is subjected. The hand controller 10 with its associated computer can hence be used to control movement of, for example, a manipulator slave arm (not shown). The forces and torques experienced by such a slave arm may be detected, and the operator can be provided with force (and torque) feedback by energising the rotary actuators 26 appropriately.

I claim

1. An actuator assembly which comprises a pair of arms, each arm comprising upper and lower arm sections pivotally connected to each other, with said upper arm sections being joined at a three-axis universal joint, and with said lower arm sections being attached independently of each other to a respective one of two rotary actuators, both rotary actuators being secured to a base via a common pivoting member.

2. An actuator assembly as claimed in claim 1 wherein the rotary actuators are direct drive motors.

3. An actuator assembly as claimed in claim 2 wherein the direct drive motors are brushless DC torque motors.

4. A hand controller which comprises three actuator assemblies as claimed in claim 1 secured to a top plate via their three axis universal joints, the bases of the three actuator assemblies being spaced apart from each other.

5. A hand controller which comprises three actuator assemblies as claimed in claim 2 secured to a top plate via their three axis universal joints, the bases of the three actuator assemblies being spaced apart from each other.

6. A hand controller which comprises three actuator assemblies as claimed in claim 3 secured to a top plate via their three axis universal joints, the bases of the three actuator assemblies being spaced apart from each other.

* * * * *